US007901299B2

(12) United States Patent
Kim et al.

(10) Patent No.: US 7,901,299 B2
(45) **Date of Patent: *Mar. 8, 2011**

(54) TWO-PIECE GOLF BALL HAVING AN IMPROVED CORE COMPOSITION

(75) Inventors: Hyun Jin Kim, Carlsbad, CA (US); Dean A. Snell, Oceanside, CA (US); David Pierick, San Diego, CA (US); Kelvin T. Okamoto, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/217,467

(22) Filed: Jul. 3, 2008

(65) Prior Publication Data

US 2008/0274825 A1 Nov. 6, 2008

Related U.S. Application Data

(63) Continuation of application No. 11/125,815, filed on May 10, 2005, now Pat. No. 7,462,113.

(51) Int. Cl.
*A63B 37/00* (2006.01)

(52) U.S. Cl. ..... 473/351

(58) Field of Classification Search ..... 473/378, 473/351, 367, 368

See application file for complete search history.

(56) References Cited

U.S. PATENT DOCUMENTS

| | | | | |
|---|---|---|---|---|
| 3,560,573 | A * | 2/1971 | Haydn et al. | 568/65 |
| 5,252,652 | A * | 10/1993 | Egashira et al. | 524/392 |
| 7,462,113 | B2 * | 12/2008 | Kim et al. | 473/378 |
| 2004/0230006 | A1 * | 11/2004 | Voorheis et al. | 525/261 |

* cited by examiner

*Primary Examiner* — Raeann Trimiew
(74) *Attorney, Agent, or Firm* — Klarquist Sparkman, LLP

(57) ABSTRACT

The present invention is directed to a two-piece golf ball having a core and a cover, wherein the core comprises at least one unsaturated polymer, at least one cross-linking agent, at least one co-cross-linking agent, and at least one peptizer (comprising one or more organic sulfur compounds, or one or more metal or non-metal salts of an organic sulfur compound), and optionally at least one weight adjusting filler. The improved two-piece balls have optimal velocity and distance performance, as well as excellent shot feel, the called "long and soft" combination. The balls also demonstrate excellent durability properties, and ease of manufacture.

16 Claims, 1 Drawing Sheet

FIGURE
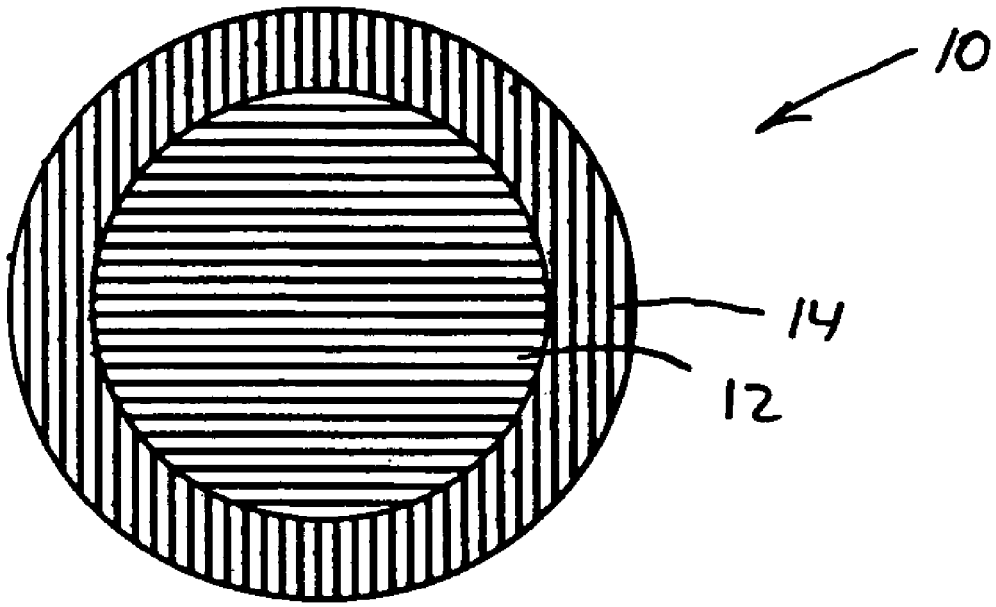

TWO-PIECE GOLF BALL HAVING AN IMPROVED CORE COMPOSITION

CROSS-REFERENCE TO RELATED APPLICATIONS

This is a continuation of U.S. application Ser. No. 11/125,815, filed on May 10, 2005, the entire contents of which are herein incorporated by reference.

Priority is claimed under 35 U.S.C. §119(e) to U.S. Provisional Patent Application No. 60/569,839, filed on May 10, 2004, entitled "Two-Piece Golf Ball Having an Improved Core Composition," by Hyun Jin Kim, Dean A. Snell, David Pierick, and Kelvin T. Okamoto, which application is incorporated by reference herein.

BACKGROUND OF THE INVENTION

This invention relates generally to golf balls, and, more specifically, to a two-piece golf ball. In particular, this invention relates to a two-piece golf ball having a core and an outer cover layer, wherein the core composition comprises at least one peptizer. The two-piece golf balls of the present invention provide an increase in driver ball speed, or the ball's coefficient of restitution ("C.O.R."), as compared to balls having an identical core and outer cover layer, but lacking a peptizer.

Until relatively recently, many highly skilled, low-handicap golfers had utilized wound golf balls for competitive play. These balls have a wound core (i.e., a liquid or solid center and elastic windings) and a balata or balata-like cover.

Balata-covered wound golf balls are known for their soft feel and high spin rate potential. However, balata-covered balls suffer from the drawback of low durability. Among other things, even in normal use, the balata cover can become cut and scuffed, making the ball unsuitable for further play.

For golf ball cover materials, balata was generally the industry standard until about the middle 1960's, when E.I. DuPont de Nemours & Co. introduced a new series of resins, now known as ionomers (see U.S. Pat. No. 3,264,272, ("the '272 patent")). These ionomeric resins have been found to function quite well as golf ball cover materials (see U.S. Pat. No. 3,454,280). The ionomeric resins are sold by DuPont under the trademark Surlyn®. Although the '272 patent identified above teaches a wide variety of compounds, only a relatively few resins are available commercially. The ionomeric resins are copolymers of an olefin and an $\alpha,\beta$-ethylenically unsaturated carboxylic acid, with 5-100% of the carboxylic acid groups being neutralized by metal ions.

Although balata is still used to a considerable extent, the ionomeric resins have dominated the golf ball cover market and have replaced the balata covers except for particularly exceptional golfers and those who seek to emulate them. Reasons for the success of these ionomeric resins include their improved cut resistance, as compared to balata, their substantially cheaper price, and their ready availability. In connection with the latter reason, it is pointed out that balata is a natural resin imported from foreign countries and its availability, at best, is erratic, and prices fluctuate accordingly.

When making golf ball covers, the Surlyn® resins can be used individually or they can be blended together. U.S. Pat. No. 3,819,768 teaches that a blend of a sodium salt of an ionomer resin with a zinc salt of an ionomer resin will provide improved cold-cracking properties.

Until the late 1960's, a balata cover was typically used with a so-called wound core, comprising a center and a long, thin elastic band wrapped tightly thereabout. The internal elastic windings are susceptible to breakage upon ball striking, and the center of the ball can be knocked off center or "out of round." Furthermore, the coefficient of restitution of wound balls is reduced at low temperatures.

In the late 1960's, compositions were developed that could replace the wound cores. It was originally thought that these materials could replace both the core and the cover, thus enabling the production of a unitary, homogeneous golf ball. However, the unitary golf balls have not been found to be of sufficiently high quality for play by most golfers. Unitary golf balls are played by some golfers, and a large number of such balls are used as practice balls in driving ranges and the like. Nevertheless, the consensus of opinion today is that a high-grade golf ball should include a unitary solid core of approximately the dimensions of a wound core, together with a cover thereon.

The golf industry has generally settled on one type of core composition for use in solid golf balls to achieve the best properties. This composition is polybutadiene with a high cis-1,4-content, cross-linked using peroxide or sulfur compounds, a zinc dimethacrylate or zinc diacrylate co-cross-linking agent, and a filler such as zinc oxide. Of the two co-cross-linkers, zinc diacrylate, has been found to produce golf balls having greater initial velocity than zinc dimethacrylate.

These core compositions provide improved properties; however, even with the blending of materials, ideal properties have not been achieved in golf balls. For example, a high C.O.R. is preferred because, as mentioned above, it correlates with greater ball flight distance. An increased loading level of sulfur compounds, peroxides, or acrylate metal salts in the polybutadiene rubber used for a core composition is known to increase C.O.R. However, this also will lead to increased core compression, resulting in poorer ball feel. This relationship between C.O.R. and compression can be adjusted only to a limited extent using known activators, cross-linking agents, and co-cross-linking agents.

A variety of other materials, such as fillers and processing aids, also have been used in making golf balls cores. For example, small amounts of chemical peptizers have been incorporated in golf ball cores. These peptizers generally are used in small amounts to retard the initial curing of polybutadiene rubber under the influence of mechanical force, heat, or a combination of these. Use of these peptizers allows for incorporation of a wider array of active chemical ingredients and fillers in a composition. These peptizers also provide for easier processing of these compositions, as well as lower processing temperatures.

For example, U.S. Pat. No. 5,252,652 discloses that adding an organic sulfur compound and/or a metal-containing organic sulfur compound to the rubber composition used to prepare the core of a one-piece or a multi-layered golf ball, the resulting ball exhibits an increased initial driver velocity and improved flying performance. The rubber composition contains an organic sulfur compound and/or a metal-containing organic sulfur compound in addition to the base rubber, unsaturated carboxylic acid metal salt, and organic peroxide.

U.S. Pat. No. 5,776,012 discloses a solid golf ball comprising a core and a cover, wherein the core is formed from a vulcanized molded material of a rubber composition comprising a base rubber, a metal salt of an unsaturated carboxylic acid, an organic peroxide, an organic sulfur compound and/or a metal-containing organic sulfur compound, and a filler. The organic sulfur compound and metal-containing organic sulfur compound are said to accelerate mastication of the rubber, thereby enhancing the rebound performance of the soft part of the core. The organic sulfur compound can be diphenyl disulfide, dixylyl disulfide, pentachlorothiophenol, thiobenzoic acid, morpholine disulfide, etc. The metal-containing organic sulfur compound can be a zinc salt of thiophenols or thiocarboxylic acids.

U.S. Patent Publication No. 2003/0064826A1 and U.S. Pat. No. 6,635,716 disclose that adding a halogenated organic sulfur compound or the salts thereof, in particular, pentachlorothiophenol ("PCTP") salt, to polybutadiene rubber compositions used in golf ball cores provides increased C.O.R., decreased compression, or both. The polybutadiene rubber composition may include between about 2.2 parts and about 5 parts of a halogenated organic sulfur compound, or the metal salt thereof. The metal salt may be zinc, calcium, potassium, magnesium, sodium, or lithium, but is preferably zinc.

The United States Golf Association ("USGA") has set certain standards for golf balls. The initial velocity of the golf ball is set at a maximum of 255 feet per second (250 feet per second with a 2% tolerance), when measured using USGA standards. Golf ball manufacturers strive to come as close to this limit as possible, without exceeding it. However, it has proven difficult for solid golf balls to reach this limit. An improvement of only one-half foot per second is considered significant.

It therefore will be appreciated that there is a need for an improved two-piece golf ball having an optimal velocity and distance performance and excellent shot feel, the so-called "long and soft" combination, while also providing excellent durability properties and ease of manufacture. The present invention fulfills this need and provides further related advantages.

SUMMARY OF THE INVENTION

The present invention is embodied in a two-piece golf ball having a core and a cover, wherein the core comprises at least one unsaturated polymer, at least one cross-linking agent, at least one co-cross-linking agent, and at least one peptizer selected from the group consisting of organic sulfur compounds, metal salts of an organic sulfur compound, non-metal salts of an organic sulfur compound, and combinations thereof, and optionally at least one weight adjusting filler.

More particularly, the core has a PGA compression, $C_c$, preferably in the range of about 30 to about 100, more preferably in the range of about 40 to about 90, and most preferably about 50 to about 80. Further the cover has a material Shore D hardness preferably in the range of about 35 to about 75, more preferably in the range of about 40 to about 70, and most preferably in the range of about 50 to about 65. Further, the cover has a thickness preferably in the range of about 0.015 to about 0.100 inches, more preferably in the range of about 0.025 to about 0.085 inches, and most preferably in the range of about 0.035 to about 0.075 inches. The final golf ball has a PGA compression, $B_c$, that preferably meets the following inequality:

$$40+C_c \geqq B_c \geqq C_c-40;$$

more preferably:

$$30+C_c \geqq B_c \geqq C_c-30;$$

and most preferably:

$$25+C_c \geqq B_c \geqq C_c-25;$$

wherein $C_c$ is the core PGA compression.

In addition, the at least one unsaturated polymer is a polybutadiene having a Mooney viscosity ($ML_{1+4}$ (100° C.)) preferably in the range of about 20 to about 80, more preferably in the range of about 30 to about 60, and most preferably in the range of about 35 to about 50.

The peptizer, if an organic sulfur compound or a metal salt of an organic sulfur compound, is present in an amount preferably in the range of about 0.01 to about 2.0 parts by weight, more preferably in the range of about 0.1 to about 1.0 parts by weight, and most preferably in the range of about 0.30 to about 0.80 parts by weight, per 100 parts by weight of the unsaturated polymer. In addition, the peptizer, if a non-metal salt of an organic sulfur compound, is present in an amount preferably in the range of about 0.01 to about 10 parts by weight, more preferably in the range of about 0.1 to about 7 parts by weight, and most preferably in the range of about 0.15 to about 5 parts by weight, per 100 parts by weight of the unsaturated polymer.

In another more detailed feature of the invention, applicable when the peptizer is an organic sulfur compound or a metal salt thereof, the cross-linking agent(s) is present in the core preferably in the range of about 0.05 to about 5 parts by weight, more preferably in the range of about 0.2 to about 3 parts by weight, and most preferably in the range of about 0.5 to about 1.5 parts by weight, per 100 parts by weight of the unsaturated polymer. The cross-linking agent(s) preferably is selected from the group consisting of sulfur compounds, peroxides, chemical cross-linking agents, free-radical initiators, and combinations thereof.

In one form of the invention, two cross-linking agents are used, including a first agent having a first characteristic decomposition temperature less than 150° C. for a $t_{1/2}$ of 0.1 hour and a second agent having a second characteristic decomposition temperature greater than 150° C. for a $t_{1/2}$ of 0.1 hour. The first and second cross-linking agents have a composition mole ratio preferably in the range of 5:95 to 95:5, and more preferably in the range of 10:90 to 50:50.

In another more detailed feature of the invention, the core includes an accelerator in an amount preferably in the range of about 0.1 to about 10 parts by weight, more preferably in the range of about 0.2 to about 5 parts by weight, and most preferably in the range of about 0.5 to about 1.5 parts by weight, per 100 parts by weight of the unsaturated polymer. The accelerator preferably is selected from the group consisting of 2-mercaptobenzothiazole and a salt of 2-mercaptobenzothiazole.

In yet another detailed feature of the invention, the cover comprises an ionomeric polymer, a bimodal ionomeric polymer, a modified ionomeric polymer, or a combination thereof. In particular, the ionomeric polymer can comprise one or more E/X/Y copolymers, wherein E is ethylene, X is a $C_3$ to $C_8$ α,β-ethylenically unsaturated carboxylic acid, and Y is a softening comonomer selected from the group consisting of alkyl acrylate and alkyl methacrylate, wherein the alkyl groups have from 1-8 carbon atoms, or ionomers of such E/X/Y copolymers, wherein X is in the range of about 2 to about 30 weight % of the E/X/Y copolymer, and Y is in the range of 0 to about 35 weight % of the E/X/Y copolymer, and wherein the acid groups present in said ionomeric polymer are partially neutralized with a metal selected from the group consisting of zinc, sodium, lithium, calcium, magnesium, and combinations thereof.

Further, the bimodal ionomeric polymer can comprise (1) a high molecular weight component having a molecular weight in the range of about 80,000 to about 500,000 and comprising one or more ethylene/α,β-ethylenically unsaturated $C_{3-8}$ carboxylic acid copolymers and/or one or more ethylene, alkyl(meth)acrylate, (meth)acrylic acid terpolymers, wherein said high molecular weight component is partially neutralized with metal ions selected from the group consisting of lithium, sodium, zinc, calcium, magnesium, and combinations thereof, and (2) a low molecular weight component having a molecular weight in the range of about 2,000 to about 30,000 and comprising one or more ethylene/α,β-ethylenically unsaturated $C_{3-8}$ carboxylic acid copolymers and/or one or more ethylene, alkyl(meth)acrylate, (meth) acrylic acid terpolymers, wherein said low molecular weight component is partially neutralized with metal ions selected from the group consisting of lithium, sodium, zinc, calcium, magnesium, and combinations thereof.

The modified ionomeric polymer can comprise either a blend composition (described below) or a bimodal polymer blend composition (also described below). The blend composition includes (1) ethylene, (2) 5 to 25 weight percent (meth)acrylic acid (based on the total weight of said modified ionomeric polymer), (3) 0 to 40 weight percent of a 1 to 8C-alkyl acrylate (based on the total weight of said modified ionomeric polymer), and (4) from about 5 to about 40 weight percent (based on the total weight of said modified ionomeric polymer), of a fatty acid or one or more metal salts of a fatty acid. The bimodal polymer blend composition includes (1) a high molecular weight component having a molecular weight in the range of about 80,000 to about 500,000 and comprising one or more ethylene/α,β-ethylenically unsaturated $C_{3-8}$ carboxylic acid copolymers and/or one or more ethylene, alkyl (meth)acrylate, (meth)acrylic acid terpolymers, wherein said high molecular weight component is partially neutralized with metal ions selected from the group consisting of lithium, sodium, zinc, calcium, magnesium, and combinations thereof; (2) a low molecular weight component having a molecular weight in the range of about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers, wherein said low molecular weight component is partially neutralized with metal ions selected from the group consisting of lithium, sodium, zinc, calcium, magnesium, and combinations thereof; and (3) about 5 to about 40 weight percent (based on the total weight of said modified ionomeric polymer) of a fatty acid or one or more metal salts of a fatty acid.

In yet another more detailed feature of the invention, the cover further includes a zinc-neutralized ionomer of a polymer of ethylene, wherein (meth)acrylic acid is present in an amount in the range of about 5 to about 25 weight % (based on the total weight of said zinc neutralized ionomer), and a (meth)acrylate ester present in an amount in the range of 0 to about 50 weight % (based on the total weight of said zinc neutralized ionomer). Further, the modified ionomeric polymer preferably comprises about 30 to about 40 weight percent (based on the total weight of said modified ionomeric polymer) of one or more fatty acids or metal salts of a fatty acid, wherein the metal is selected from the group consisting of calcium, sodium, zinc, lithium, magnesium, barium, and combinations thereof. In addition, about 40 to 100 percent of the acid groups present in said modified ionomeric polymer are neutralized with a metal selected from the group consisting of zinc, sodium, lithium, calcium, magnesium, and combinations thereof.

In yet another more detailed feature of the invention, the core and/or the cover further include a polymer other than an ionomeric or modified ionomeric polymer. This additional polymer preferably is selected from the group consisting of thermoplastic elastomers, thermoset elastomers, synthetic rubber, thermoplastic vulcanizates, polycarbonate, polyolefin, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene catalyzed polymers, styrene-acrylonitrile (SAN) (including olefin-modified SAN and acrylonitrile-styrene-acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, and combinations thereof.

In other more detailed features of the invention, the core can include a center and one or more core layers disposed around the center. The Shore D hardness difference between adjacent layers is greater than about 2, with the hardness alternatively increasing or decreasing outwards from the center to the outermost core layer. Further, the core can further include at least one weight-adjusting filler. The overall ball preferably has a coefficient of restitution greater than about 0.790.

Other features and advantages of the present invention should become apparent from the following description of the preferred embodiments, taken in conjunction with the accompanying drawing, which illustrates, by way of example, the principles of the invention.

BRIEF DESCRIPTION OF THE DRAWING

The FIGURE is a cross-sectional view of a golf ball embodying the invention, the ball including a core and a cover layer.

DESCRIPTION OF THE PREFERRED EMBODIMENTS

Any numerical values recited herein include all values from the lower value to the upper value, in increments of one unit, provided that there is a separation of at least 2 units between any lower value and any higher value. As an example, if it is specified that the amount of a component or a value of a process variable is from 1 to 90, preferably from 20 to 80, and more preferably from 30 to 70, it is intended that values such as 15 to 85, 22 to 68, 43 to 51, 30 to 32 etc. are expressly included in this specification. For values having less than one unit difference, one unit is considered to be 0.1, 0.01, 0.001, or 0.0001, as appropriate. Thus all possible combinations of numerical values between the lowest value and the highest value enumerated herein should be considered to be expressly stated in this application.

The term "(meth)acrylic acid copolymers" is intended to mean copolymers of methacrylic acid and/or acrylic acid.

The term "(meth)acrylate" is intended to mean monomers of methacrylic acid and/or acrylic acid esters.

The term "hydrocarbyl" is intended to mean any aliphatic, cycloaliphatic, aromatic, aryl substituted aliphatic, aryl substituted cycloaliphatic, aliphatic substituted aromatic, or cycloaliphatic substituted aromatic groups. The aliphatic or cycloaliphatic groups are preferably saturated. Likewise, the term "hydrocarbyloxy" is intended to mean a hydrocarbyl group having an oxygen linkage between it and the carbon atom to which it is attached.

The term "outer cover layer" is used interchangeably with the term "cover layer" and it is intended to mean the outermost layer of the golf ball.

With reference now to the FIGURE, there is illustrated a golf ball 10 that includes a solid center or core 12 and a cover layer 14. The core is formed as a solid, spherical body, and the cover layer is disposed around the core.

Golf Ball Core Construction

The composition of the core 12 includes an unsaturated polymer, a cross-linking agent, a co-cross-linking agent, a peptizer, and an optional accelerator. These ingredients are described below:

A. Unsaturated Polymer

Unsaturated polymers suitable for use in the golf balls of the present invention include any polymeric material having an unsaturation, either hydrocarbon or non-hydrocarbon, capable of participating in a cross-linking reaction initiated thermally, chemically, by irradiation, or by a combination of these methods. Non-limiting examples of suitable unsaturated polymers include 1,2-polybutadiene, cis-1,4-polybutadiene, trans-1,4-polybutadiene, cis-polyisoprene, trans-polyisoprene, polychloroprene, polybutylene, styrene-butadiene rubber, styrene-butadiene-styrene block copolymer, styrene-isoprene-styrene block copolymer, nitrile rubber, silicone rubber, and polyurethane, as well as mixtures of these.

The base rubber can be any rubber commonly used in conventional one-piece golf balls and in the cores of multi-layered golf balls. The preferred base rubbers are polybutadiene rubbers, especially poly(1,4-butadiene) rubbers containing at least 40 mol %, and more preferably 80 to 100 mol % of cis-1,4 bonds, because of their high rebound resilience, moldability, and high strength after vulcanization.

The polybutadiene rubbers have a molecular weight distribution in the range of about 1.2 to about 4.0, preferably about 1.7 to about 3.5, more preferably about 2.0 to about 3.0, and most preferably about 2.1 to about 2.8. In addition, the polybutadiene rubbers have a Mooney viscosity ($ML_{1+4}$ (100° C.)) in the range of about 20 to about 80, preferably about 30 to about 70, more preferably about 30 to about 60, and most preferably about 35 to about 50.

The term "Mooney viscosity" used herein refers in each case to an industrial index of viscosity, as measured using a Mooney viscometer, which is a type of rotary plastometer (see JIS K6300). This value is represented by the symbol $ML_{1+4}$ (100° C.), wherein "M" stands for Mooney viscosity, "L" stands for large rotor (L-type), "1+4" stands for a preheating time of 1 minute and a rotor rotation time of 4 minutes, and "100° C." indicates that measurement was carried out at a temperature of 100° C.

The cis-1,4 polybutadiene component may be synthesized using conventional catalysts, including rare earth-based catalysts, nickel-based catalysts, or cobalt-based catalysts, conventionally used in this field.

Polybutadiene obtained using lanthanum rare earth-based catalysts is usually synthesized by polymerizing butadiene in the presence of a catalyst comprising a combination of a lanthanum rare earth-compound, an organic aluminum compound, a Lewis base and, upon necessity, a Lewis acid. The lanthanum rare earth-compound may be a compound containing a rare earth atom (atomic number of 57 to 71), but particularly preferred is a neodymium compound.

Examples of the nickel-based catalysts may include a one-component type such as nickel diatomaceous earth, a two-component type such as Raney-nickel/titanium tetrachloride, and a three-component type such as a nickel compound/organic metal/boron trifluoride etherate. Examples of nickel compounds may include reduced nickel with carrier, Raney-nickel, nickel oxide, nickel carboxylate, and a complex salt of organic nickel. Examples of the organic metals may include a trialkyl aluminum such as triethyl aluminum, tri-n-propyl aluminum, tri-isobutyl aluminum, or tri-n-hexyl aluminum; an alkyl lithium such as n-butyl lithium, sec-butyl lithium, tert-butyl lithium, or 1,4-dibutane lithium; and a dialkyl zinc such as diethyl zinc or dibutyl zinc.

Examples of the cobalt-based catalysts may include, as cobalt and compounds thereof, Raney-cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyl dithiocarbamate, cobalt anilinium nitrite, and cobalt dinitrosyl chloride. Each of these compounds is preferably combined with a dialkyl aluminum monochloride such as diethyl aluminum monochloride or diisobutyl aluminum monochloride, a trialkyl aluminum such as triethyl aluminum, tri-n-propyl aluminum, triisobutyl aluminum or tri-n-hexyl aluminum, an aluminum alkyl sesquichloride such as ethyl aluminum sesquichloride, or aluminum chloride.

The poly(1,4-butadiene) rubbers can also be blended with natural rubber, polyisoprene rubber, styrene-butadiene rubber, or the like. At least 80% by weight of poly(1,4-butadiene) rubber should be present in the base rubber, because base rubbers containing less poly(1,4-butadiene) rubber often fail to take advantage of the rebound resilience of the polybutadiene rubber.

Many different types of 1,2-polybutadienes exist, having widely varying physical properties as a result of their differing tacticity, crystallinity, and molecular weight. Examples of 1,2-polybutadienes having differing tacticity, all of which are suitable as unsaturated polymers for use in the present invention, are atactic 1,2-polybutadiene, isotactic 1,2-polybutadiene, and syndiotactic 1,2-polybutadiene. Syndiotactic polymers include alternating base units that are enantiomers of each other. These 1,2-polybutadienes also are differentiated by their crystallinity, which ranges from amorphous 1,2-polybutadienes that essentially lack crystallinity to semi-crystalline 1,2-polybutadienes that have different crystallinities in their structures. The molecular weights of these 1,2-polybutadienes can vary greatly. The various combinations of tacticity, crystallinity, and molecular weight provide for many different types of 1,2-polybutadienes having very different processability, as well as other chemical, thermal, mechanical, and rheological properties.

Syndiotactic 1,2-polybutadiene having crystallinity suitable for use as an unsaturated polymer in compositions within the scope of the present invention are polymerized from a 1,2-addition of butadiene. Golf-balls within the scope of the present invention include core compositions comprising syndiotactic 1,2-polybutadiene having crystallinity and greater than about 70% of 1,2-bonds, more preferably greater than about 80% of 1,2-bonds, and most preferably greater than about 90% of 1,2-bonds. Also, golf balls within the scope of the present invention include syndiotactic 1,2-polybutadiene having crystallinity between about 5% and about 50%, more preferably between about 10% and about 40%, and most preferably between about 15% and about 30%. In addition, golf balls within the scope of the present invention include syndiotactic 1,2-polybutadiene having crystallinity and a mean molecular weight between about 10,000 and about 350,000, more preferably between about 50,000 and about 300,000, even more preferably between about 80,000 and about 200,000, and most preferably between about 10,000 and about 150,000.

Examples of a suitable syndiotactic 1,2-polybutadiene having crystallinity for use in golf balls within the scope of the present invention are sold under the trademarks RB810, RB820, and RB830, by JSR Corporation of Tokyo, Japan. These have more than 90% of 1,2 bonds, a mean molecular weight of approximately 120,000, and crystallinity between about 15% and about 30%.

B. Cross-Linking Agent

Suitable cross-linking agents for use in the golf balls of the present invention include any sulfur compounds, peroxides, or other known chemical cross-linking agents, and free-radical initiators, as well as mixtures of these. Non-limiting examples of suitable cross-linking agents include primary, secondary, or tertiary aliphatic or aromatic peroxides. Peroxides containing more than one peroxy group can be used, such as 2,5-dimethyl-2,5-di(tert-butylperoxy)hexane and 1,4-di-(2-tert-butyl peroxyisopropyl)benzene. Both symmetrical and asymmetrical peroxides can be used, for example, tert-butyl perbenzoate and tert-butyl cumyl peroxide. Peroxides incorporating carboxyl groups also are suitable. The decomposition of peroxides used as cross-linking agents in the present invention can be brought about by applying thermal energy, shear, irradiation, reaction with other chemicals, or any combination of these. Both homolytically and heterolytically decomposed peroxide can be used in the present invention.

Non-limiting examples of suitable peroxides include diacetyl peroxide; di-tert-butyl peroxide; dibenzoyl peroxide; dicumyl peroxide; 2,5-dimethyl-2,5-di(benzoylperoxy)hexane; 1,4-bis-(t-butylperoxyisopropyl)benzene; t-butylperoxybenzoate; 2,5-dimethyl-2,5-di-(t-butylperoxy)hexyne-3, such as Trigonox 145-45B, marketed by Akrochem Corp. of Akron, Ohio; 1,1-bis(t-butylperoxy)-3,3,5 tri-methylcyclohexane, such as Varox 231-XL, marketed by R.T. Vanderbilt Co., Inc. of Norwalk, Conn.; and di-(2,4-dichlorobenzoyl) peroxide. The cross-linking agents can be blended in total amounts of about 0.05 part to about 5 parts, more preferably about 0.2 part to about 3 parts, and most preferably about 0.5 part to about 1.5 parts, by weight of the cross-linking agents per 100 parts by weight of the unsaturated polymer.

Each cross-linking agent has a characteristic decomposition temperature at which 50% of the cross-linking agent has decomposed when subjected to that temperature for a specified time period ($t_{1/2}$). For example, 1,1-bis(t-butylperoxy)-3,3,5-trimethylcyclohexane at $t_{1/2}$=0.1 hr has a decomposition temperature of 138° C., and 2,5-dimethyl-2,5-di-(t-butylperoxy)hexyne-3 at $t_{1/2}$=0.1 hr has a decomposition temperature of 182° C. Two or more cross-linking agents having different characteristic decomposition temperatures at the same $t_{1/2}$ may be blended in the composition. For example, where a first cross-linking agent has a first characteristic decomposition temperature less than 150° C., and a second cross-linking agent has a second characteristic decomposition temperature greater than 150° C., the composition weight ratio of the first cross-linking agent to the second cross-linking agent can range from 5:95 to 95:5, or more preferably from 10:90 to 50:50. Typically, the characteristic decomposition temperature for each peroxide decreases for longer specified time periods.

As an alternative to the use of chemical cross-linking agents, exposure of the composition to radiation can serve as a cross-linking agent. Radiation can be applied to the unsaturated polymer mixture by any known method, including using microwave or gamma radiation, or an electron beam device.

C. Co-Cross-Linking Agent

The metal salt of unsaturated carboxylic acid is blended with the rubber as a co-cross-linking agent. Examples of these include zinc and magnesium salts of unsaturated acids having 3 to 8 carbon atoms, such as acrylic acid, methacrylic acid, maleic acid, and fumaric acid, with the zinc salts of acrylic and methacrylic acid being most preferred. The unsaturated carboxylic acid metal salt can be blended in a rubber either as a preformed metal salt, or by introducing an α,β-unsaturated carboxylic acid and a metal oxide or hydroxide into the rubber composition, and allowing them to react in the rubber composition to form a metal salt. The unsaturated carboxylic acid metal salt can be blended in any desired amount, but preferably in amounts of about 20 parts to about 60 parts by weight of the unsaturated carboxylic acid per 100 parts by weight of the unsaturated polymer.

D. Peptizer

The compositions used to formulate the cores of the balls of the present invention may also incorporate one or more peptizers. The term "peptizer" is intended to mean chemicals that both inhibit cross-linking during the initial processing of unsaturated polymers and further participate in the cross-linking of the unsaturated polymer when cross-linking does begin.

The peptizer preferably comprises an organic sulfur compound and/or its metal or non-metal salt. Examples of the organic sulfur compound include thiophenols, such as pentachlorothiophenol and its metal and non-metal salts, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di(pentachlorophenyl) disulfide; dibenzamido diphenyldisulfide (DBDD), and alkylated phenol sulfides, such as VULTAC marketed by Atofina Chemicals, Inc. of Philadelphia, Pa. Preferred organic sulfur compounds include pentachlorothiophenol, and dibenzamido diphenyldisulfide. Examples of the metal salt of an organic sulfur compound include sodium, potassium, lithium, magnesium, calcium, barium, cesium and zinc salts of the above-mentioned thiophenols and thiocarboxylic acids, with the zinc salt of pentachlorothiophenol being most preferred. Examples of the non-metal salt of an organic sulfur compound include ammonium salts of the above-mentioned thiophenols and thiocarboxylic acids wherein the ammonium cation has the general formula $[NR^1R^2R^3R^4]^+$, wherein each of $R^1$, $R^2$, $R^3$ and $R^4$ can be either hydrogen or a $C_1$-$C_{20}$ aliphatic, cycloaliphatic or aromatic moiety, with the most preferred being $R^1$ to $R^4$=H to obtain the $NH_4^+$-salt of pentachlorothiophenol.

When the peptizer employed in the cores of the golf balls of the present invention is an organic sulfur compound or a metal salt of an organic sulfur compound, it is preferably employed in an amount in the range of about 0.01 to about 2.00, more preferably about 0.10 to about 1.00, and most preferably about 3.00 to about 0.80, parts by weight per 100 parts by weight of the unsaturated polymer component. In addition, the cross-linking agent may be present in an amount from about 0.05 to about 0.4 pph.

When the peptizer employed in the cores of the golf balls of the present invention is a non-metal salt of an organic sulfur compound, it is preferably employed in an amount in the range of about 0.01 to about 10, more preferably about 0.10 to about 7, and most preferably about 0.15 to about 5, parts by weight per 100 parts by weight of the unsaturated polymer component.

E. Accelerators

The golf ball core composition can comprise one or more accelerators of one or more classes. Accelerators added to an unsaturated polymer increase the vulcanization rate and/or decrease the vulcanization temperature of the unsaturated polymers. Accelerators can be of any class known for rubber processing including mercapto-, sulfenamide-, thiuram, dithiocarbamate, dithiocarbamylsulfenamide, xanthate, guanidine, amine, thiourea, and dithiophosphate accelerators. Specific commercial accelerators include 2-mercaptobenzothiazole and its metal or non-metal salts, such as Vulkacit Mercapto C, Mercapto MGC, Mercapto ZM-5, and ZM marketed by Bayer AG of Leverkusen, Germany, Nocceler M, Nocceler MZ, and Nocceler M-60 marketed by Ouchisinko Chemical Industrial Company, Ltd. of Tokyo, Japan, and MBT and ZMBT marketed by Akrochem Corporation of Akron, Ohio. A more complete list of commercially available accelerators is given in *The Vanderbilt Rubber Handbook:* 13$^{th}$ Edition (1990, R.T. Vanderbilt Co.), pp. 296-330, in *Encyclopedia of Polymer Science and Technology*, Vol. 12 (1970, John Wiley & Sons), pp. 258-259, and in *Rubber Technology Handbook* (1980, Hanser/Gardner Publications), pp. 234-236. Preferred accelerators include 2-mercaptobenzothiazole (MBT) and its salts. The ball composition can further incorporate from about 0.1 part to about 10 parts by weight of the accelerator per 100 parts by weight of the unsaturated polymer. More preferably, the ball composition can further incorporate from about 0.2 part to about 5 parts, and most preferably from about 0.5 part to about 1.5 parts, by weight of the accelerator per 100 parts by weight of the unsaturated polymer.

Golf balls within the scope of the present invention can be prepared by molding the rubber composition, as formulated above, into a spherical core of desired size and by then vulcanizing the rubber by heating. The manufacture of these spheres can be in accord with conventional methods and conditions of manufacture.

The resulting cores preferably have a PGA compression in the range of about 30 to about 100, more preferably about 40 to about 90, and most preferably about 50 to about 80.

In one embodiment of the present invention the core may comprise a center and one or more core layers disposed around the center. These core layers may be made from the same rubber as used in the center portion, or these may be a different thermoplastic elastomer. The various core layers (including the center) may each exhibit a different hardness. The Shore D hardness difference between the center hardness and that of the next adjacent layer, as well as between the various core layers, preferably is greater than 2, more preferably greater than 5, and most preferably greater than 10.

In one preferred embodiment, the hardness of the center and each sequential layer increases progressively outwards, from the center to outer core layer.

In an alternative preferred embodiment, the hardness of the center and each sequential layer decreases progressively outwards, from the center to the outer core layer.

After the core has been made, the cover layer is then formed over it.

Cover Layer Construction

With reference again to the FIGURE, the cover layer 14 of the golf ball 10 is disposed over the spherical core 12. The composition of the cover layer is described as follows:

The cover layer 14 can comprise one or more ionomer resins or blends thereof. Preparation of such ionomers is well known, for example as disclosed in U.S. Pat. No. 3,264,272, the entire contents of which are herein incorporated by reference. The ionomer resins have long been utilized in golf ball formulations and have, to a large extent, replaced balata as a stock material for golf ball covers. Generally speaking, commercial ionomers include a polymer of a mono-olefin, e.g., an alkene, with an unsaturated mono- or dicarboxylic acid having 3 to 12 carbon atoms. An additional monomer in the form of a mono- or dicarboxylic acid ester may also be incorporated in the formulation as a so-called "softening comonomer."

The incorporated carboxylic acid groups are then neutralized by a basic metal ion salt, to form the ionomer. The metal ions used for neutralization include $Li^+$, $Na^+$, $K^+$, $Zn^{2+}$, $Co^{2+}$, $Ni^{2+}$, $Cu^{2+}$, $Pb^{2+}$, and $Mg^{2+}$, with $Li^+$, $Na^+$, $Zn^{2+}$, and $Mg^{2+}$ being preferred. The basic metal ion salts include those of, for example, formic acid, acetic acid, nitric acid, carbonic acid, hydrogen carbonate salts, oxides, hydroxides, and alkoxides.

The first commercially available ionomer resins contained up to 16 weight percent acrylic or methacrylic acid, although even at that time, it was well known that, as a general rule, further increasing the acid content of these cover materials would further increase their hardness. Thus, DuPont Research Disclosure 29703, published in January, 1989, first disclosed ionomers based on ethylene/acrylic acid or ethylene/methacrylic acid containing acid contents of greater than 15 weight percent. In this same disclosure, DuPont also taught that such so-called "high acid ionomers" had significantly improved stiffness and hardness and thus could be advantageously used in golf ball construction, when used either singly or in a blend with other ionomers.

More recently, high-acid ionomers are typically defined as those ionomer resins having acrylic or methacrylic acid units present from 16 wt. % to about 35 wt. % in the polymer. Generally, such high-acid ionomers have a flexural modulus in the range of about 50,000 psi to about 125,000 psi.

Ionomer resins can further comprise a softening comonomer, which is typically present in the range of about 10 wt. % to about 50 wt. % in the polymer. Such ionomers have a flexural modulus of about 2,000 psi to about 10,000 psi, and they are sometimes referred to as "soft" or "very low modulus" ionomers. Typical softening comonomers include n-butyl acrylate, iso-butyl acrylate, n-butyl methacrylate, methyl acrylate, and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which may be used as a component of the balls of the present invention. The properties of these ionomer resins can vary widely due to variations in acid content, softening comonomer content, the degree of neutralization, and the type of metal ion used in the neutralization. The full range of commercially available resins typically includes ionomers of polymers of general formula, E/X/Y, where E is ethylene, X is a softening comonomer such as acrylate or methacrylate present in an amount of from 0 wt. % to about 50 wt. % of the polymer, and Y is acrylic or methacrylic acid present in an amount from about 5 wt. % to about 35 wt. % of the polymer, and wherein the acid moiety is neutralized in the range of about 1% to about 90%, to form an ionomer with a cation such as lithium, sodium, potassium, magnesium, calcium, barium, lead, tin, zinc, or aluminum, or a combination of such cations.

Other examples of ionomers suitable for use in the cover layer of the golf balls of the present invention include ionomers based on the so-called bimodal ionomers, as described in U.S. Pat. No. 6,562,906, the entire contents of which are herein incorporated by reference. These ionomers are bimodal, because they are prepared from blends comprising polymers of different molecular weights. Specifically, they include bimodal polymer blend compositions comprising the following:

a) a high molecular weight component having molecular weight of about 80,000 to about 500,000 and comprising one or more ethylene/$\alpha,\beta$-ethylenically unsaturated $C_{3-8}$ carboxylic acid copolymers and/or one or more ethylene, alkyl(meth)acrylate, (meth)acrylic acid terpolymers; said high molecular weight component being partially neutralized with metal ions selected from the group consisting of lithium, sodium, zinc, calcium, magnesium, and mixtures of any these; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, zinc, calcium, magnesium, and mixtures of any these.

The cover layer may also comprise one or more so-called modified ionomeric polymers, comprising one or more so-called "modified ionomers," examples of which are described in U.S. Pat. Nos. 6,100,321, 6,616,552, and 6,329,458, and US Patent Publication US 2003/0158312 A1, the entire contents of all of which are herein incorporated by reference.

More particularly, the one or more modified ionomeric polymers can be prepared by mixing the following ingredients:

a) an ionomeric polymer comprising ethylene, from 5 to 25 weight percent (meth)acrylic acid, and from 0 to 40 weight percent of a (meth)acrylate monomer, said ionomeric polymer neutralized with metal ions selected from the group consisting of lithium, sodium, zinc, calcium, magnesium, and a mixture of any of these, and b) one or more fatty acids or metal salts of said fatty acid, the metal selected from the group consisting of calcium, sodium, zinc, lithium, barium and magnesium and said fatty acid preferably being stearic acid.

The fatty or waxy acid salts utilized in the invention are composed of a chain of alkyl groups containing from about 4 to 75 carbon atoms (usually even numbered) and characterized by a —COOH terminal group. The generic formula for all fatty and waxy acids above acetic acid is $CH_3$ $(CH_2)_X$ COOH, wherein the carbon atom count includes the carboxyl group. The fatty or waxy acids utilized to produce the fatty or waxy acid salts incorporated into the invention may be saturated or unsaturated, and they may be present in either solid, semi-solid or liquid form.

Examples of suitable saturated fatty acids, i.e., fatty acids in which the carbon atoms of the alkyl chain are connected by single bonds, include but are not limited to stearic acid ($C_{18}$, i.e., $CH_3$ $(CH_2)_{16}COOH$), palmitic acid ($C_{16}$, i.e., $CH_3$ $(CH_2)_{14}COOH$), pelargonic acid ($C_9$, i.e., $CH_3(CH_2)_7$ COOH) and lauric acid ($C_{12}$, i.e., $CH_3(CH_2)_{10}COOH$). Examples of suitable unsaturated fatty acids, i.e., a fatty acid in which there are one or more double bonds between the carbon atoms in the alkyl chain, include but are not limited to oleic acid ($C_{13}$, i.e., $CH_3(CH_2)_7CH{:}CH(CH_2)_7COOH$).

The source of the metal ions used to produce the metal salts of the fatty or waxy acid salts also incorporated into the invention are generally various metal salts which provide the metal ions capable of neutralizing, to various extents, the carboxylic acid groups of the fatty acids. These include the sulfate, carbonate, acetate and hydroxylate salts of zinc, barium, calcium, and magnesium.

The fatty acid salts utilized in the invention comprise various combinations of fatty acids neutralized with a large number of different metal ions. Consequently, several different types of fatty acid salts may be utilized in the invention, including metal stearates, laureates, oleates, and palmitates, with calcium, zinc, sodium, and magnesium stearate being preferred, and calcium and sodium stearate being most preferred.

The fatty or waxy acid or metal salt of said fatty or waxy acid is present in the modified ionomeric polymers preferably in an amount of from about 5 to about 40, more preferably from about 7 to about 35, and most preferably from about 8 to about 20 weight percent (based on the total weight of said modified ionomeric polymer).

As a result of the addition of the one or more metal salts of a fatty or waxy acid, preferably from about 40 to 100, more preferably from about 50 to 100, and most preferably from about 70 to 100 percent of the acidic groups in the final modified ionomeric polymer composition are neutralized by a metal ion.

An example of such a modified ionomer polymer is DuPont® HPF-1000, available from E.I duPont de Nemours and Co. Inc.

Other examples of modified ionomeric polymers for use in the cover layer of the golf balls of the present invention are those prepared by modifying (again with one or more metal salts of a fatty or waxy acid) ionomers based on the so-called bimodal ethylene/carboxylic acid polymers, as described in U.S. Pat. No. 6,562,906, the entire contents of which are herein incorporated by reference. These polymers are bimodal because they result from blending two polymers of different molecular weights.

These modified bimodal ionomeric polymers comprise the following:

a) a high molecular weight component having a molecular weight in the range of about 80,000 to about 500,000 and comprising one or more ethylene/α,β-ethylenically unsaturated $C_{3-8}$ carboxylic acid copolymers and/or one or more ethylene, alkyl(meth)acrylate, (meth)acrylic acid terpolymers, wherein the high molecular weight component is partially neutralized with metal ions selected from the group consisting of lithium, sodium, zinc, calcium, magnesium, and mixtures of any of these;

b) a low molecular weight component having a molecular weight in the range of about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers, wherein the low molecular weight component is partially neutralized with metal ions selected from the group consisting of lithium, sodium, zinc, calcium, magnesium, and mixtures of any these; and c) one or more fatty acids or metal salts of fatty acids, in the range of about 5 to about 40 weight percent (based on the total weight of said modified ionomeric polymer), wherein the metal is selected from the group consisting of calcium, sodium, zinc, lithium, barium, and magnesium, and the fatty acid preferably is stearic acid.

Again, the fatty or waxy acid salts utilized in the modified bimodal ionomeric polymers are composed of a chain of alkyl groups containing from about 4 to 75 carbon atoms (usually even numbered) and characterized by a —COOH terminal group. The generic formula for all fatty or waxy acids above acetic acid is $CH_3(CH_2)_X$ COOH, wherein the carbon atom count includes the carboxyl group. The fatty or waxy acids utilized to produce the fatty or waxy acid salts incorporated into the invention may be saturated or unsaturated, and they may be present in either solid, semi-solid, or liquid form.

Examples of suitable saturated fatty acids, i.e., fatty acids in which the carbon atoms of the alkyl chain are connected by single bonds, include but are not limited to stearic acid ($C_{18}$, i.e., $CH_3(CH_2)_{16}COOH$), palmitic acid ($C_{16}$, i.e., $CH_3$ $(CH_2)_{14}COOH$), pelargonic acid ($C_9$, i.e., $CH_3$ $(CH_2)_7$ COOH), and lauric acid ($C_{12}$, i.e., $CH_3(CH_2)_{10}COOH$). Examples of suitable unsaturated fatty acids, i.e., a fatty acid in which there are one or more double bonds between the carbon atoms in the alkyl chain, include but are not limited to oleic acid ($C_{13}$, i.e., $CH_3$ $(CH_2)_7CH{:}CH(CH_2)_7COOH$).

The source of the metal ions used to produce the metal salts of the fatty or waxy acid salts identified above are generally various metal salts that provide the metal ions capable of neutralizing, to various extents, the carboxylic acid groups of the fatty acids. These include the sulfate, carbonate, acetate, and hydroxylate salts of zinc, barium, calcium, and magnesium.

The fatty or waxy acid salts utilized in the invention comprise various combinations of fatty or waxy acids neutralized with a large number of different metal ions. Consequently, several different types of fatty acid salts may be utilized in the invention, including metal stearates, laureates, oleates, and palmitates, with calcium, zinc, sodium, and magnesium stearate being preferred, and calcium and sodium stearate being most preferred.

The fatty or waxy acid or metal salt of said fatty or waxy acid in the modified bimodal ionomeric polymers is present in an amount in the range of preferably about 5 to about 45, more preferably about 7 to about 35, and most preferably about 8 to about 20 weight percent (based on the total weight of said modified ionomeric polymer).

Again, because of the addition of the fatty or waxy acids, or one or more metal salts of a fatty or waxy acid, preferably about 40 to 100, more preferably about 50 to 100, and most preferably about 70 to 100 percent, of the acidic groups in the final modified bimodal ionomeric polymer composition are neutralized by a metal ion.

In a preferred embodiment, the modified ionomeric polymer composition further comprises a zinc-neutralized ionomer of a polymer having the general formula. E/X/Y, where E is ethylene, X is a softening comonomer such as acrylate or methacrylate and is present in an amount in the range of preferably 0 to about 50, more preferably 0 to about 25, and most preferably 0, and Y is acrylic or methacrylic acid and is present in an amount in the range of preferably about 5 to about 25, more preferably about 10 to about 25, and most preferably about 10 to about 20, wt %.

It is also understood that the cover layer 14 may also comprise any and all blend combinations of the aforementioned ionomers and/or modified ionomers.

In addition, the material used to prepare the cover layer of the golf ball of the present invention is not limited to ionomer resins. Other possible materials for use in the cover layer include other thermoplastics, thermosets, polyurethanes, polyesters, polyamide elastomers, polyamide-ionomers, polyurethane ionomers, thermoplastic copolyetherester block copolymers, thermoplastic copolyesterester block copolymers, thermoplastic polyurethanes, thermoset polyurethanes, dynamically vulcanized thermoplastic elastomers, styrene-butadiene, styrene-isoprene and styrene-isoprene elastomers with a functional group such as maleic anhydride or sulfonic acid, thermoplastic or thermoset metallocene-catalyzed polyolefin resins, and any and all combinations thereof.

Additional Materials

In addition to the materials discussed above, the core 12 and cover layer 14 of the golf ball 10 of the present invention can further incorporate one or more additional polymers. Examples of suitable additional polymers include, but are not limited to, the following: thermoplastic elastomer, thermoset elastomer, synthetic rubber, thermoplastic vulcanizate, copolymer ionomer, terpolymer ionomer, polyurethane ionomer, polyamide ionomer, polycarbonate, polyolefin, polyamide, copolymeric polyamide, polyester, polyvinyl alcohol, acrylonitrile-butadiene-styrene copolymer, polyarylate, polyacrylate, polyphenylene ether, impact-modified polyphenylene ether, high impact polystyrene, diallyl phthalate polymer, metallocene catalyzed polymer, styrene-acrylonitrile (SAN) (including olefin-modified SAN and acrylonitrile-styrene-acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, and any metallocene-catalyzed polymers of these species.

Suitable polyamides for use as an additional material in compositions within the scope of the present invention also include resins obtained by, (1) polycondensation of (a) a dicarboxylic acid, e.g., oxalic acid, adipic acid, sebacic acid, terephthalic acid, isophthalic acid, or 1,4-cyclohexanedicarboxylic acid, with (b) a diamine, e.g., ethylenediamine, tetramethylenediamine, pentamethylenediamine, hexamethylenediamine, decamethylenediamine, 1,4-cyclohexyldiamine or m-xylylenediamine; (2) a ring-opening polymerization of cyclic lactam, e.g., ϵ-caprolactam or ω-laurolactam; (3) polycondensation of an aminocarboxylic acid, e.g., 6-aminocaproic acid, 9-aminononanoic acid, 11-aminoundecanoic acid or 12-aminododecanoic acid; or (4) copolymerization of a cyclic lactam with a dicarboxylic acid and a diamine. Specific examples of suitable polyamides include nylon 6, nylon 66, nylon 610, nylon 612, nylon 11, nylon 12, copolymerized nylon, nylon MXD6, and nylon 46.

Other preferred materials suitable for use as an additional material in compositions within the scope of the present invention include polyester elastomers marketed under the trademark SKYPEL™ by SK Chemicals of South Korea, or diblock or triblock copolymers marketed under the trademark SEPTON™ by Kuraray Corporation of Kurashiki, Japan, and KRATON™ by Kraton Polymers Group of Companies of Chester, United Kingdom. All of the materials listed above can provide particular enhancements to ball layers prepared within the scope of the present invention.

The various polymer compositions used to prepare the golf balls of the present invention can also incorporate one or more fillers. Such fillers are typically in a finely divided form, e.g., in a size preferably less than about 20 mesh, and more preferably less than about 100 mesh, U.S. standard size, except for fibers and flock, which are generally elongated. Flock and fiber sizes should be small enough to facilitate processing. Filler particle size will depend upon the desired effect, cost, ease of addition, and dusting considerations. The appropriate amounts of filler required will vary depending on the application, but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten steel copper, cobalt or iron, metal alloys, tungsten carbide, metal oxides, metal stearates, and other particulate carbonaceous materials, and any and all combinations thereof. Preferred examples of fillers include metal oxides such as zinc oxide and magnesium oxide. In another preferred embodiment, the filler comprises a continuous or non-continuous fiber.

If desired, the various polymer compositions used to prepare the golf balls of the present invention can additionally contain other conventional additives such as plasticizers, pigments, antioxidants, U.V. absorbers, optical brighteners, or any other additives generally employed in plastics formulation or the preparation of golf balls. The appropriate amounts for these materials can be readily determined without undue experimentation.

Preparation of Golf Balls

Typically, the golf ball core 12 is made by mixing together the unsaturated polymer, cross-linking agents, and other additives, with or without melting them. Dry blending equipment, such as a tumble mixer, V-blender, ribbon blender, or two-roll mill, can be used to mix the compositions. The golf ball compositions can also be mixed using a mill, an internal mixer such as a Banbury or Farrel continuous mixer, an extruder, or combinations of these, with or without application of thermal energy to produce melting. The various core components can be mixed together with the cross-linking agents, or each additive can be added in an appropriate sequence to the milled unsaturated polymer. In another method of manufacture, the cross-linking agents and other components can be added to the unsaturated polymer as part of a concentrate using dry blending, roll milling, or melt mixing. If radiation is a cross-linking agent, then the mixture comprising the unsaturated polymer and other additives can be irradiated following mixing, during forming into a part such as the core of a ball, or after forming.

The resulting mixture is formed into a solid sphere for the core using, for example, a compression or injection molding process. The polymer mixture is subjected to a molding cycle in which heat and pressure are applied while the mixture is confined within a mold. The cavity shape depends on the portion of the golf ball being formed. The compression and heat liberates free radicals by decomposing one or more peroxides, which initiate cross-linking. The temperature and duration of the molding cycle are selected based upon the type of peroxide and peptizer selected. The molding cycle may have a single step of molding the mixture at a single temperature for a fixed time duration.

A preferred mode for making the cores used in the present invention is to first mix the core ingredients on a two-roll mill, to form slugs of approximately 30-40 g, and then compression-mold in a single step, at a temperature in the range of 150 to 180° C., for a time duration between 5 and 12 minutes.

The various core components may also be combined to form a golf ball by an injection molding process, which also is well known to those of ordinary skill in the art. The required curing time will vary depending on the various materials selected, and those of ordinary skill in the art will be readily able to adjust the curing time upward or downward based on the particular materials used and the discussion herein.

The cover formulations may be produced using a twin-screw extruder or can be blended manually or mechanically prior to the addition to the injection molder feed hopper. Finished golf balls may be prepared by initially positioning the solid, preformed core in an injection-molding cavity, followed by uniform injection of the cover layer composition sequentially over the core. The cover formulations can be injection molded around the cores to produce golf balls of the required diameter.

Alternatively, the cover layers may be formed around the core by first forming half shells by injection molding followed by compression molding the half shells about the core to form the final ball.

Further, the cover layers may alternatively be formed around the cores using compression molding. Cover materials for compression molding may also be extruded or blended resins or castable resins such as polyurethane.

The cover layer of the golf balls of the present invention preferably has a thickness in the range of preferably about 0.015 to about 0.100 in, more preferably about 0.025 to about 0.085 in, and most preferably about 0.035 to about 0.075 in. The cover layer also preferably has a Shore D hardness in the range of preferably about 35 to about 75, more preferably about 40 to about 70, and most preferably about 50 to about 65.

The final two-piece golf ball of the present invention has a PGA compression, $B_c$, that preferably meets the following inequality:

$$40+C_c \geqq B_c \geqq C-40;$$

more preferably:

$$30+C_c \geqq B_c \geqq C_c-30;$$

and most preferably:

$$25+C_c \geqq B_c \geqq C_c-25;$$

wherein $C_c$ is the core PGA compression.

EXAMPLES

Examples of the invention are given below by way of illustration and not by way of limitation.

The following materials were used to prepare the golf balls summarized in Table 1.

Core Components and Preparation

A series of cores were prepared, each having a diameters of 1.54 in. and suitable for use in golf balls within the scope of the present invention. Each core incorporated the following materials:

BR40, which is a cis-1,4-polybutadiene rubber, made with a rare earth catalyst and commercially available from Enichem.

ZnO, which is a rubber-grade zinc oxide purchased from Akrochem (Akron, Ohio).

ZDA, which is zinc diacrylate purchased commercially from Sartomer under the trademarks SR416, SR638, and SR529, among others, and which may be used interchangeably or in combination.

$BaSO_4$, which is Polywate 2000 barium sulfate purchased from Cimbar.

Varox 231XL, which is 1,1-di(t-butylperoxy)-3,3,5-trimethyl-cyclohexane cross-linking initiator (40% active peroxide), and which is commercially available from R.T. Vanderbilt and is made by Atofina.

Ammonium Pentachlorothiophenol, which is made from pentachlorothiophenol (purchased from Dannier Chemicals) and which is suspended in xylenes (100 g in 250 ml). The suspension is stirred, warmed to 35° C. To this suspension, 1 molar equivalent of concentrated aqueous ammonium hydroxide is added and allowed to react for 5 min. with stirring. Upon addition of ammonium hydroxide, the suspension immediately changes color from a green grey to a yellow orange color. On cooling, the resulting suspended ammonium pentachlorothiophenol is then isolated by filtration, washed with xylene, and dried under vacuum at room temperature for 72 hrs.

Zinc Pentachlorothiophenol, which is purchased from Dannier Chemicals.

The cores each incorporated cis-1,4-polybutadiene, as the base rubber. Additionally, the cores incorporated zinc oxide, zinc diacrylate, and a peroxide cross-linking initiator.

The core ingredients were mixed on a two-roll mill, and slugs of approximately 34.5 g were formed and compression molded at 170° C., for seven minutes. The resulting cores were then tested for C.O.R. and compression after one day aging at room temperature. Detailed composition information for the cores is provided below, in Table 1.

TABLE 1

| Core No. | BR40 (pph[1]) | Zinc Diacrylate (pph) | ZnO (pph) | BaSO4 (pph) | Varox 231XL (pph)[4] | Amm PCTP[2] | Zn PCTP[3] (pph) |
|---|---|---|---|---|---|---|---|
| 1 | 100 | 27.7 | 21.4 | 0 | 1.05 | 0 | 0.75 |
| 2 | 100 | 35.2 | 5 | 17 | 1.3 | 0.7 | 0 |

[1]pph = parts per hundred of unsaturated polymer
[2]Ammonium Pentachlorothiophenol
[3]Zinc Pentachlorothiophenol
[4]40% concentrate (1.05 pph = 0.42 pph active peroxide; 1.3 pph = 0.52 active peroxide)

Cover Layer Components

The materials employed in the blend formulations used for the cover layers were as follows:

Surlyn® 9910, which is commercially available from DuPont, and which is a zinc ionomer of an ethylene/methacrylic acid polymer.

Surlyn® 9120, which is commercially available from DuPont, and which is a zinc ionomer of an ethylene/methacrylic acid polymer.

Surlyn® 8140, which is commercially available from DuPont, and which is a sodium ionomer of an ethylene/methacrylic acid polymer.

Surlyn® 8320, which is commercially available from DuPont, and which is a sodium ionomer of an ethylene/methacrylic acid/methacrylate polymer.

Surlyn® SEP1290, which is commercially available from DuPont, and which is a bimodal ionomer of an ethylene/methacrylic acid polymer.

In addition, a color concentrate ("A2") was used in some of the cover formulations. It included 50 wt % $TiO_2$ plus other colorants and 50 wt % of a thermoplastic binder. Such a concentrate is commercially available from Carolina Color Corporation.

Final Ball Preparation

Finished golf balls were prepared by positioning the solid, preformed cross-linked polybutadiene core in an injection molding cavity, followed by uniform injection of the cover layer composition over the core. The cover layer formulation was made by hand-blending the appropriate mixture of pellets. The cover formulations were injection molded around cores of finished diameter of 1.54 inches, to produce golf balls of approximately 1.680 inches in diameter having the ball constructions and properties as summarized in Table 2.

The ball's dimple pattern included 408 dimples.

The properties of PGA compression, coefficient of restitution (C.O.R.), Shore D hardness, and other tests on either the core or the resulting ball were conducted using the test methods as defined below.

Core or ball diameter were determined by using standard linear calipers or size gauge.

Core specific gravity was determined by electronic densitometer using ASTM D-792.

Compression was measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, then the compression is rated at 100; if the spring compresses 0.1 inch, then the compression value is rated as 0. Thus, more compressible, softer materials will have lower Atti gauge values than harder, less compressible materials. Compression measured using this instrument also is referred to as PGA compression. The approximate relationship between Atti or PGA compression and Riehle compression can be expressed as follows:

(Atti or PGA compression)=(160−Riehle Compression).

Thus, a Riehle compression of 100 would be the same as an Atti compression of 60.

Coefficient of restitution (C.O.R.) of the cores or balls was measured by using an air cannon to fire the core or ball, at an inbound velocity of 125 feet per second, against a steel plate positioned 81 inches from the cannon's muzzle. The rebound velocity was then measured via a timing mechanism using two light gates. The rebound velocity was divided by the inbound velocity to yield the coefficient of restitution.

Shore D hardness was measured in accordance with ASTM Test D-2240, except that the hardness was determined perpendicular to the curved surface of the core or on the land area between the dimples on the surface of the ball.

The ball performance was determined using a Robot Driver Test, which utilized a commercial swing robot in conjunction with an optical system for measuring driver ball speed, launch angle, and backspin. In this test, a titanium driver (TaylorMade R510 having a head mass of 190 grams, a stiff shaft, and a 9.5 degree loft) was attached to a swing robot, and the swing speed and power profile, as well as tee location and club lie angle, were set-up to generate the values set forth below. A Maxfli XS Tour golf ball as a reference:

Head Speed: 112 mph
Ball Speed: 160 mph
Launch Angle: 9 deg
Backspin: 3200 rpm

The test ball then was substituted for the reference ball, and the corresponding values determined as summarized in Table 2.

Comparison of the resulting ball performance data in Table 2 illustrates that balls containing either the zinc or ammonium salt of pentachlorothiophenol had high C.O.R., which correlates to higher driver speeds.

TABLE 2

| | Example 1 | Example 2 |
|---|---|---|
| Core No | 1 | 2 |
| Core Size (In.) | 1.547 | 1.544 |
| Compression (PGA) | 65 | 60 |
| C.O.R. | 0.812 | 0.808 |
| SpG | 1.177 | 1.180 |
| Cover Composition | 36.2 wt % Surlyn ® 8140<br>40 wt % Surlyn ® 9120<br>20% Surlyn ® 8320<br>3.80 wt % A2 | 36.2 wt % Surlyn ® 8140<br>40 wt % Surlyn ® 9120<br>20% Surlyn ® 8320<br>3.80 wt % D2 |
| Pole Size (In.) | 1.685 | 1.685 |
| Equator Size (In.) | 1.682 | 1.682 |
| Compression | 90 | 89 |
| Weight (g.) | 45.6 | 45.611 |
| Cover Hardness (Shore D) | 65.4 | 64.2 |
| C.O.R. | 0.825 | 0.823 |

It should be appreciated from the foregoing description that the present invention provides an improved two-piece golf ball having a core and a cover, wherein the core comprises at least one unsaturated polymer, at least one cross-linking agent, at least one co-cross-linking agent, and at least one peptizer (comprising one or more organic sulfur compounds, or one or more metal or non-metal salts of an organic sulfur compound), and optionally at least one weight adjusting filler. The improved two-piece balls have optimal velocity and distance performance, as well as excellent shot feel, the called "long and soft" combination. The balls also demonstrate excellent durability properties, and ease of manufacture.

The invention has been described in detail with reference only to the preferred embodiments. Those skilled in the art will appreciate that various modification can be made without departing from the invention. Accordingly, the invention is defined only by the following claims.

We claim:

1. A golf ball having a core and a cover, the core comprising:

at least one unsaturated polymer;

at least one cross-linking agent;

at least one co-cross-linking agent; and at least one peptizer comprising an ammonium salt of a thiophenol or an ammonium salt of a thiocarboxylic acid.

2. The golf ball of claim 1 wherein the at least one peptizer comprises an $NH_4^+$ salt of pentachlorothiophenol.

3. The golf ball according to claim 1 where the at least one unsaturated polymer is a polybutadiene having a Mooney viscosity ($ML_{1+4}$ (100° C.)) in the range of from about 30 to about 60, and the peptizer is present in an amount in the range of from about 0.1 to about 7 parts by weight per 100 parts by weight of the unsaturated polymer.

4. The golf ball according to claim 1 wherein the core includes from about 0.05 to about 5 parts by weight of cross-linking agent per 100 parts by weight of the unsaturated polymer.

5. The golf ball according to claim 1 wherein the core includes from about 0.5 to about 1.5 parts by weight of the cross-linking agent per 100 parts by weight of the unsaturated polymer, and the cross-linking agent is selected from the group consisting of sulfur compounds, peroxides, chemical cross-linking agents, free-radical initiators, and combinations thereof.

6. The golf ball according to claim 1 wherein the at least one cross-linking agent includes:

a first cross-linking agent, having a first characteristic decomposition temperature less than 150° C. for a $t_{1/2}$ of 0.1 hour; and a second cross-linking agent, having a second characteristic decomposition temperature greater than 150° C. for a $t_{1/2}$ of 0.1 hour.

7. The golf ball according to claim 6 wherein the first and second cross-linking agents have a composition mole ratio in the range of 5:95 to 95:5.

8. The golf ball according to claim 1 wherein the core further comprises an accelerator in an amount in the range of from about 0.1 to about 10 parts by weight per 100 parts by weight of the unsaturated polymer.

9. The golf ball according to claim 1 wherein the core further comprises an accelerator selected from the group consisting of 2-mercaptobenzothiazole and a salt of 2-mercaptobenzothiazole.

10. The golf ball according to claim 1 wherein the ball has a coefficient of restitution greater than about 0.790.

11. The golf ball of claim 1 wherein the core and/or the cover further comprises a polymer other than an ionomeric or modified ionomeric polymer.

12. The golf ball of claim 11 wherein the polymer other than the ionomeric or modified ionomeric polymer is selected from the group consisting of thermoplastic elastomers, thermoset elastomers, synthetic rubber, thermoplastic vulcanizates, polycarbonate, polyolefin, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene catalyzed polymers, styrene-acrylonitrile (SAN) (including olefin-modified SAN and acrylonitrile-styrene-acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, and combinations thereof.

13. The golf ball of claim 1 wherein:

the core comprises a center and one or more core layers disposed around the center; and the Shore D hardness difference between adjacent layers is greater than about 2.

14. The golf ball of claim 13 wherein the hardness increases outwards from the center to the outermost core layer.

15. The golf ball of claim 13 wherein the hardness decreases outwards from the center to the outermost core layer.

16. The golf ball of claim 1 wherein the core further comprises at least one weight-adjusting filler.

* * * * *